US006236161B1

(12) United States Patent
Tracy et al.

(10) Patent No.: US 6,236,161 B1
(45) Date of Patent: May 22, 2001

(54) CROSSED-FIELD DEVICE

(75) Inventors: Michael L. Tracy, Danvers; Carl D. Morrill, Topsfield; Hunter L. McDowell, Concord, all of MA (US)

(73) Assignee: Communications & Power Industries, Inc., Beverly, MA (US)

( * ) Notice: Subject to any disclaimer, the term of this patent is extended or adjusted under 35 U.S.C. 154(b) by 0 days.

(21) Appl. No.: 09/259,643

(22) Filed: Feb. 26, 1999

Related U.S. Application Data

(60) Provisional application No. 60/101,469, filed on Sep. 23, 1998.

(51) Int. Cl.[7] ..... H01J 25/42; H01J 23/05

(52) U.S. Cl. ..... 315/39.3; 315/39.63; 315/39.67; 330/47

(58) Field of Search ..... 315/39.3, 39.51, 315/39.63, 39.67; 331/89; 330/47

(56) References Cited

U.S. PATENT DOCUMENTS 2,967,264 * 1/1961 Dench ..... 315/39.63
2,971,121 * 2/1961 Dench ..... 315/39.63 X
3,255,422 6/1966 Feinstein et al. ..... 330/43
3,577,172 * 5/1971 Dench ..... 315/39.3
3,614,515 * 10/1971 Wilczek ..... 315/39.3 X
3,619,709 * 11/1971 Dudley ..... 315/39.3
5,280,218 1/1994 Smith ..... 315/39.3
5,412,281 * 5/1995 Farney et al. ..... 315/39.3

* cited by examiner

*Primary Examiner*—Benny T. Lee
(74) *Attorney, Agent, or Firm*—Nutter, McClennen & Fish LLP

(57) ABSTRACT

A crossed-field device such as a crossed-field amplifier or magnetron has a generally peripheral cathode body portion and an anode which cooperates with a crossed magnetic field to maintain emitted electrons on cycloidal and amplify an rf input signal as it travels to an rf outlet. A control electrode positioned generally at a drift region away from the crossed-field amplification region interrupts the sustained electron emission to shut down the device between working cycles, and an auxiliary electrode positioned internally of the cathode diverts electrons into a gap proximally of the control electrode to reduce the control electrode energy requirements. The cathode is carried by a support structure, and the auxiliary electrode may be a rod axially extending in a counter-bore in the support structure. The auxiliary electrode is dc biased and may advantageously operate at anode potential, thereby obviating the need for any additional power source for the auxiliary electrode. Preferably the auxiliary electrode forms an inverted magnetron arrangement with the cathode counterbore and diverts electrons from the active region without creating unwanted rf output signal components.

17 Claims, 4 Drawing Sheets

CROSSED-FIELD DEVICE

CROSS REFERENCE TO RELATED APPLICATION

This application is related to provisional patent application Ser. No. 60/101,469 filed on Sep. 23, 1998. The benefit of that provisional filing is hereby claimed.

STATEMENT REGARDING FEDERALLY SPONSORED RESEARCH

Not applicable.

BACKGROUND OF THE INVENTION

The present invention relates to pulsed or intermittently operated crossed-field devices such as magnetrons and crossed field amplifiers (CFAs). By way of example, U.S. Pat. No. 3,255,422 shows one such CFA device wherein a microwave entry waveguide provides radio frequency energy to an entry port for a slow wave propagating structure on an anode. A cathode is opposed to this anode across a gap. A solenoid maintains a magnetic field perpendicular to the applied electric field. The cathode is formed of a material having a secondary emission ratio greater than unity so that electrons emitted from the cathode due to the electric field follow re-entrant trajectories in the magnetic field and bombard the cathode to cause further electron emission. Energy exchange between the emitted electrons and the rf field results in amplification of the input signal, which is then coupled out at a microwave outlet port as an amplified signal.

Because the cathode is formed of a material selected to copiously emit secondary electrons, such devices, if not provided with a means for shutting down the electron emission, could continue to run spontaneously even when the input rf is removed. Thus, as set forth in the aforesaid U.S. Pat. No. 3,255,422, it is customary to provide a control electrode which during a turn-off phase is pulsed near anode potential to capture electrons and end the secondary electron re-emission. However, the control electrode requires a relatively high-powered pulse and high potential to dependably quench the electron flux. This may result in an inflexibility of operating characteristics, so that the device does not work dependably with power supplies or drivers having slightly different characteristics, or fails to shut down after hot, relatively long, operating cycles. Thus, for example, when used to amplify or supply high energy radar pulse sequences, shut down may become erratic when used with different models of power supply or pulse timing units.

Accordingly, it would be desirable to provide a crossed-field device having improved shut-down characteristics.

It would further be desirable to provide such a device wherein the control electrode operates at a lower potential or energy.

SUMMARY OF THE INVENTION

The present invention overcomes deficiencies of known devices by providing a crossed-field device such as a crossed-field amplifier or magnetron wherein a distributed cathode body is spaced from an anode to provide an electric field in a traveling wave region between an rf inlet and an rf outlet. The traveling wave region is arranged to have a magnetic field oriented perpendicular to the electric field, so that some electrons emitted by the cathode cycle back to the cathode. A control electrode is positioned to interrupt the operation of the device by collecting some of the circulating electron flux in the gap, and by diverting the remainder of the electron flux to an auxiliary electrode. The diversion of electron flux to an auxiliary electrode reduces the energy requirements on the control electrode. In a preferred embodiment, the cathode extends along a cylindrical arc, and the control electrode occupies a segment extending along a minor portion of the periphery and spaced from, but along a generally continuous contour with, the cathode. The auxiliary electrode is positioned in a gap, and preferably behind the cathode syrface, so that electrons traveling along the amplification path are diverted away from the cathode and the traveling wave path before reaching the control electrode.

Preferably, the cathode is dimensioned appropriately for the frequency of the input rf drive, with the dimensions of height and diameter under several inches each for the case of L-band operation. The cathode is carried by an insulating support structure and the auxiliary electrode may be a rod which extends axially parallel to but spaced from the cathode, in a gap between the cathode and control electrode. The auxiliary electrode may be positioned in a counterbore in the cathode support structure, where it operates as a second anode in the crossed field to capture electrons from the gap. Preferably the auxiliary electrode is operated above cut-off so that electrons are rapidly and completely collected.

BRIEF DESCRIPTION OF THE DRAWINGS

These and other features of the invention will be understood from the description below taken together with the drawings wherein.

DETAILED DESCRIPTION OF THE INVENTION

Figure 1:
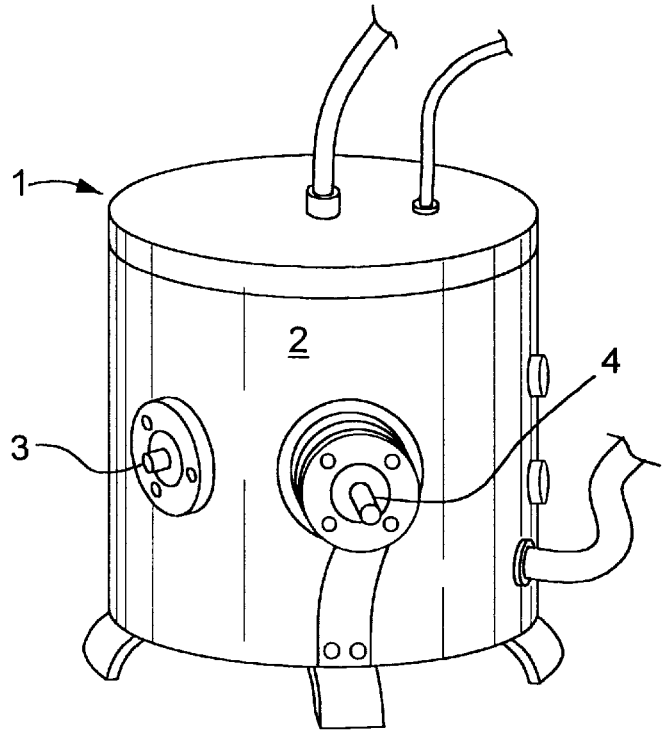
FIG. 1 PRIOR ART
FIGS. 1 and 1A illustrate a crossed field amplifier (CFA) device of the prior art.

FIG. 1 illustrates a perspective view of a representative cross-field amplifier device 1 of the prior art. As shown, the cross-field amplifier device includes an inlet port 3 for providing input rf microwave energy into a body 2, where it is amplified by the crossed-field interaction as it travels to an outlet 4 which carries the amplified rf energy away. A crossed-field amplifier (CFA) tube can be described as part magnetron and part traveling wave tube. Like a magnetron it utilizes crossed electric and magnetic fields to produce rf energy from emitted electrons. Like a traveling wave tube (TWT) the electronic interaction is with a traveling wave, and the device is an amplifier. Power is generated with high efficiency for the same reasons that a magnetron operates efficiently; power is also generated at voltage levels similar to those of a magnetron, i.e., many kilovolts. As shown in FIG. 1, a CFA may look quite like a magnetron, with the same form factor but with the addition of an input port.

Figure 1A:
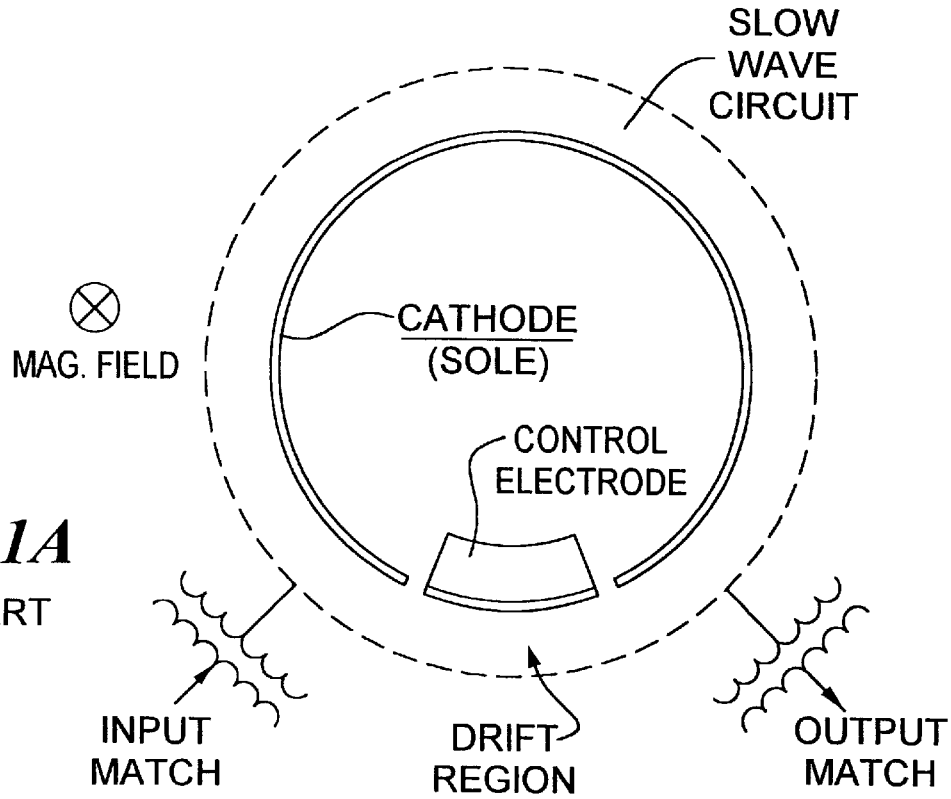
FIG. 1A PRIOR ART

FIG. 1A schematically represents the elements and operation of a CFA. The CFA device includes a slow wave circuit, an input/output system, and an electronics system. The slow wave circuit, or delay line as it sometimes called, is a periodic structure which has the circuit characteristics of a band-pass filter. It propagates rf energy over the frequency range of interest while providing fringing electric field lines with which electrons may interact. These fields must have a phase velocity approximately equal to the velocity of the electron stream. The input/output system provides an input and output impedance transformation between the rf transmission line system external to the amplifier, and the slow wave circuit itself. These impedance transformations or circuit matches may determine the useful bandwidth of the CFA itself. The electronics system generates electrons, and confines them to an interaction area, i.e., to the slow wave circuit, where they give up energy to the rf field and thus "amplify" the input energy. The electronics system also collects electrons when they are spent. Some CFAs have a relatively large cathode which extends the entire length of the slow wave circuit. In these CFAs, electrons are generated along the entire length of the cathode, giving rise to the name "distributed emission amplifier". The cathode is also called the sole, from which the name "emitting sole amplifier" has arisen. In the device of FIG. 1A, a control electrode is positioned at the drift region, and a crossed magnetic field is applied between the cathode and the anode.

The distributed emission amplifier can be arranged in a number of ways. It can be made in either a linear or a circular architecture. Amplifiers made with the circular format may collect electrons at one end of the circuit, or the input and output sections may be brought close enough together so that the electrons from the output are permitted to continue along and re-enter the interaction area at the input. Re-entrancy is employed in many amplifiers to enhance efficiency. When re-entrance is employed, however, it is possible that re-entering electrons may be modulated with information which will subsequently be amplified. This is equivalent to providing an rf feedback, and this feedback must be considered in determining the behavior of the amplifier. It is also possible to obtain re-entrance after demodulating the electron stream to eliminate such rf feedback.

CFAs are mostly used for high-power applications, as opposed to small signal use, and the slow wave circuit must be capable of dissipating the collected beam and transferring that energy to a heat sink. A typical use, for example, is as a broad band phase stable microwave amplifier for a coherent radar chain, to efficiently generate very high peak output power from a relatively low input voltage which can be either applied to the cathode or to an electrode similar to a TWT cathode, or may operate by grid pulsing. Such CFAs may be produced in small lightweight packages. The invention will be described below with respect to an essentially cylindrical arrangement of opposed cathode and anode elements in which the traveling wave or interaction region occupies a major portion of the circumference, between an rf inlet port and an rf outlet port. However, the construction of the invention may also be implemented in other distributed emission devices.

Figure 2:
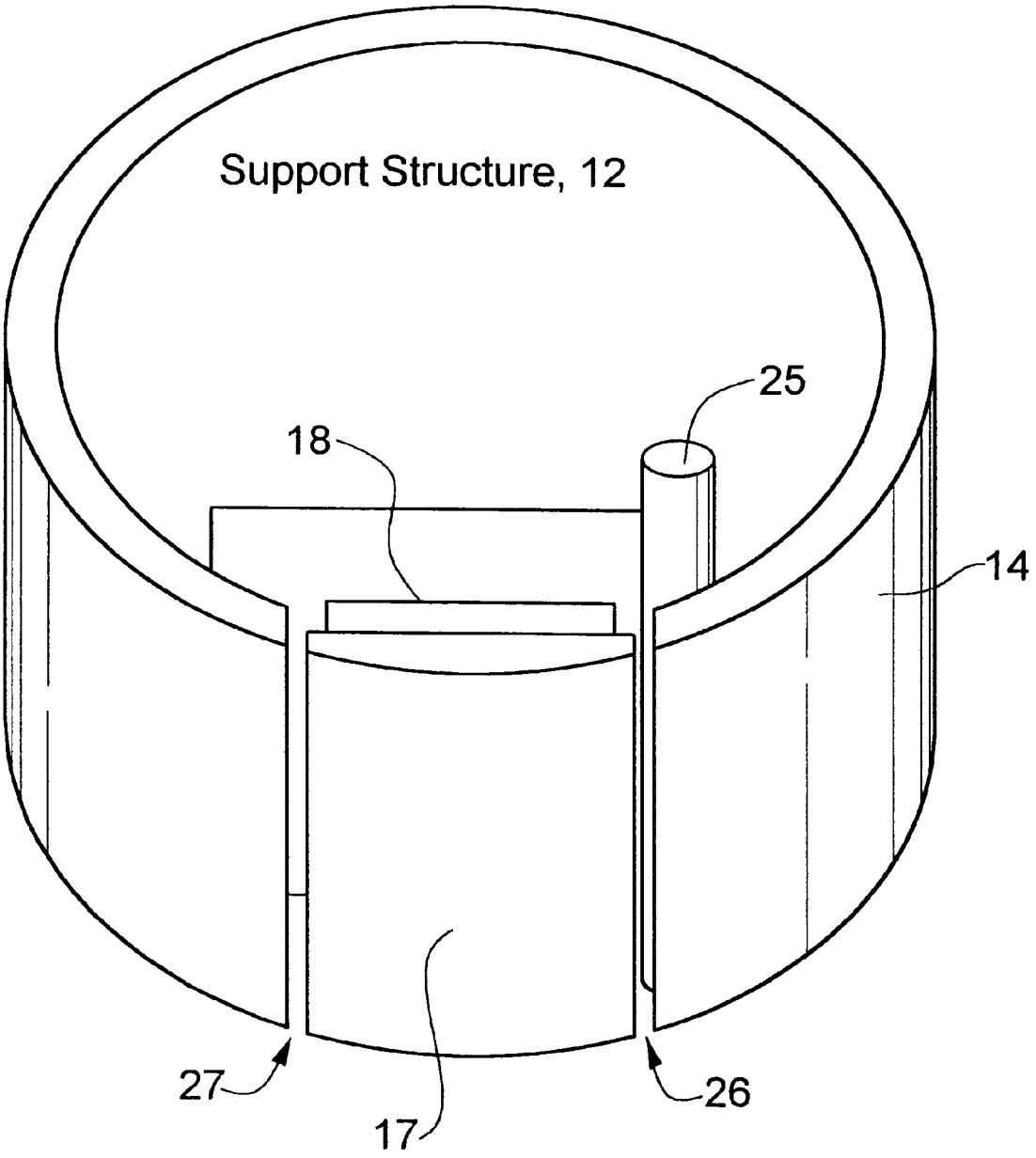
FIG. 2 illustrates a perspective view of electrode elements of one embodiment of a device of the present invention.

FIG. 2 shows an illustrative embodiment of the invention as a generally cylindrical CFA 10, in a view showing the interior electrode structure, with the anode and input/output rf matching elements removed. CFA 10 has a generally cylindrical cathode 14, control electrode 17 and auxiliary electrode 25. The control electrode 17 is supported on an insulating ceramic block 18, and is separated by spaces or gaps 26, 27 from the adjacent cathode 14.

Figure 2A:
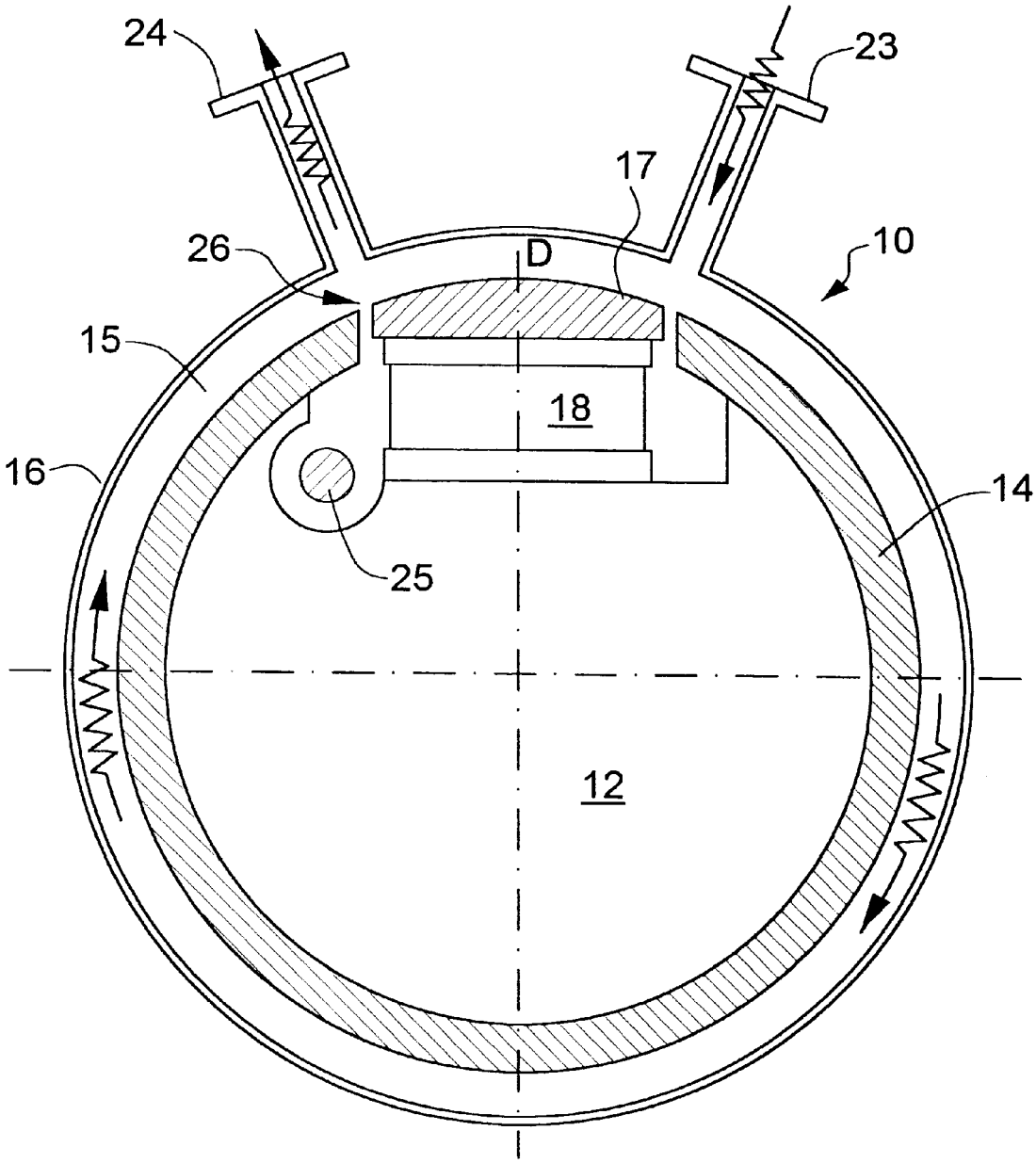
FIG. 2A shows a top view thereof.

FIG. 2A shows a top view of the device of FIG. 2, with the anode and input/output elements illustrated schematically in a section perpendicular to the cylinder axis. As shown, a central support 12 carries a cylindrical cathode 14 which is spaced across a gap 15 from the inner diameter wall of the anode structure 16. The cathode is preferably made of a cold secondary emission type material such as beryllium or platinum. For a typical L-band amplifier, the device may, have an outer diameter of approximate ten centimeters, with a cathode outer diameter of about seven centimeters and a height of approximately four centimeters. Typically the cathode is carried by a ceramic support structure, with supporting conductors of copper or other suitable metal. As further shown in FIG. 2A, an inlet 23 provides an rf input signal into the cavity or traveling wave space between the cathode surface and the anode surface, and the rf signal then travels along the peripheral gap to the rf outlet 24.

Typically the outer structure, anode 16 is maintained at ground potential, while the cathode is typically ten to twelve kilovolts negative, so that electrons are drawn from the surface of the cathode into the gap 15. The entire assembly is maintained in a permanent magnet package or solenoid (not shown) which provides a strong magnetic field in the gap 15 with lines perpendicular to the electric field.

Electrons emitted form the cathode 14 are accelerated radially outward because of the voltage potential between the cathode 14 and anode 16. If there is no rf drive power, the perpendicular (axial) magnetic field will cause the electrons to cycloid back to the cathode surface since the interaction space 15 is normally operated at a voltage below cut-off. However, when rf drive power is present, electrons emitted from the cathode 14 are sorted into two groups. The first group of electrons, known as the favorable phase electrons, give up dc potential energy to the rf wave. These electrons are collected at the anode 16. The second group of electrons, the unfavorable phase electrons, absorb some energy from the rf wave on the anode 16 circuit. With this additional energy, these electrons are driven back into the surface of cathode 14 with several hundred electron volts of energy. As a result of this electron bombardment, the cathode 14 emits new electrons with a yield $\delta$ by a process known as secondary emission. If $\delta$ is greater than one, a dense region of electrons will be maintained near the surface of the cathode 14; this dense region of electrons is usually referred to as the hub. Typically, the material of the cathode 14 has a secondary yield greater than two so that maintaining the hub is not a problem. The amount of dc energy given to the rf wave on the anode circuit by the favorable phase electrons more than offsets the amount of energy absorbed by unfavorable phase electrons, and hence there is a net rf amplification of the rf circuit wave on the anode 16.

In this manner the device amplifies the input rf drive power, so the outlet 24 receives a greatly increased rf power.

As further shown in FIG. 2A, the control electrode 17 occupies a partial circumference of the cylinder, which, in this embodiment is located in drift region D the region of the inlet and outlet rf ports, and away from the traveling wave interaction area which makes up the major portion of the circumference of the device. The control electrode 17 is supported on a ceramic support 18 which may for example be formed of beryllia ceramic. The control electrode need not itself, and preferably does not, emit electrons, and therefore is formed of copper or other robust conductor. As is understood by those skilled in the art, the control electrode operates to control the emission of electrons and to abruptly stop the high power operation of the amplifier, typically by being pulsed to near anode potential to collect electrons in the drift region D away from the interaction area so that no electrons re-enter the downstream edge of the sole after the rf input pulse has terminated. In a typical mode of operation, the cathode is maintained at negative 10.5 kV with respect to ground (anode) potential, and the control electrode is pulsed toward anode potential during the turn-off phase, i.e., at the trailing edge of the rf input pulse.

In accordance with a principle aspect of the present invention, there is also provided an auxiliary electrode 25 across a gap from the cathode 14, e.g., at the gap 26 between the cathode and the control electrode 17. As illustrated, the auxiliary electrode 25 in this embodiment is a rod extending parallel to the gap 26 and within a cavity formed in the support 12 so that it is spaced across from the cathode. Here, the auxiliary electrode is positioned on the opposite side of the cathode from the anode 16 and in a sequestered space of the insulating support. It is thus positioned to operate as a second anode to trap electrons proceeding along their cyclotron trajectories around the edge of the cathode, before they can approach the control electrode 17. For such operation, the auxiliary electrode is preferably operated from dc voltage which may advantageously be anode voltage so that no additional power source is required.

Figure 3:
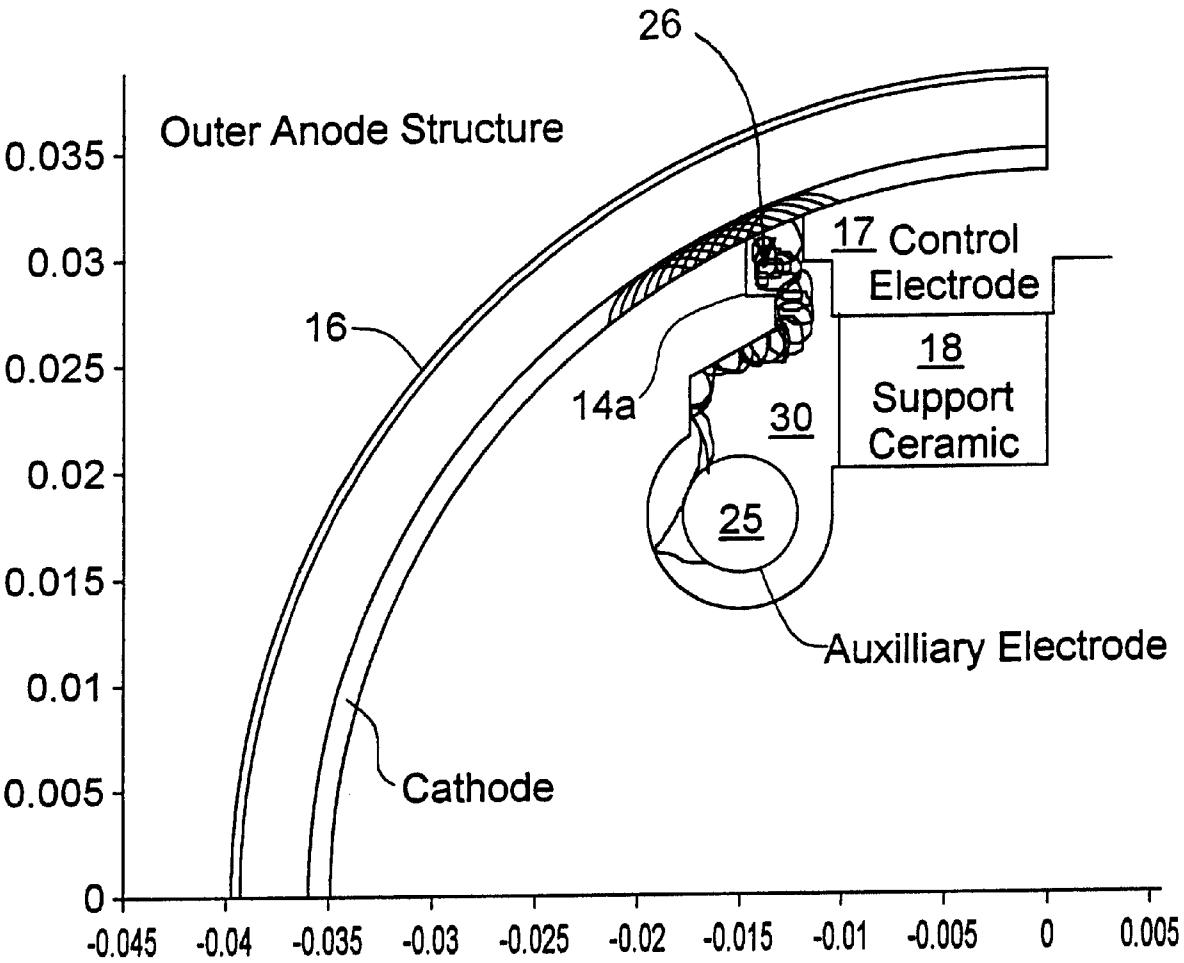
FIG. 3 illustrates operation of the device.

FIG. 3 illustrates operation of the auxiliary electrode 25 and its effect on electron paths when so energized. As shown, during early phase turn-off a substantial proportion of the electron flux at the output end of the cathode/anode gap is forced by its cyclotron trajectories to crawl around the overhung cathode edge 14*a* into a sequestered space 30 formed by the auxiliary electrode bore and control electrode gap.

The gap around the auxiliary electrode is an inverted magnetron gap, e.g., the outer electrode is at cathode potential and the auxiliary (inner) electrode is at anode potential. This gap is designed so that it is "cut-off" in order to more effectively obtain electron collection on the auxiliary electrode. The equation for cut-off $V_{co}$ voltage in a magnetron gap is:

$$V_{co} = \frac{1}{2}\frac{e_o}{m_o}B^2(r_c - r_a)^2\left[\frac{r_c + r_a}{2r_a}\right]^2$$

where $e_o$=1.6021×10$^{-19}$ C, $m_o$=9.1091×10$^{-}$ kg, B is the axial (z directed) magnetic field in Tesla, $r_c$ is the counterbore radius around the auxiliary electrode in meters, and $r_a$ is the radius of the auxiliary electrode in meters. The radii $r_a$ and $r_c$ are thus chosen so that the operating voltage between the auxiliary electrode and the cathode, V, is greater than $V_{co}$.

The auxiliary electrode need not be round as shown, but may have another shape, with the gap arranged accordingly for the magnetic field so the gap between the auxiliary electrode and the cathode is cut-off. For example, in a planar gap the cut-off voltage is given by:

$$V_{co} = \frac{e_o}{2m_o}B^2d^2$$

where d is the separation between the auxiliary electrode and the cathode, and the other parameters are as described above.

The preferred location of the auxiliary electrode is inside the cathode outer diameter and generally behind the space 26 between the control electrode 17 and the cathode 14 on the end associated with the rf output waveguide. Some interaction space electrons move between this gap and migrate into the auxiliary electrode between the outer anode structure 16 and the support ceramic 18 of the control electrode as illustrated by the typical trajectories of the FIG. 3, which shows Brillouin hub electrons during the early phase of turn-off when the control electrode may be, for example, about 1 kV above the cathode potential.

The location of auxiliary electrode may be at various positions inside the outer diameter of the cathode and a cavity 30 ahead of the control electrode. The concept also extends to the case wherein additional holes or slots are formed in the control electrode to allow more electron flow through for collection by an auxiliary electrode extending behind the holes.

Measurements were made on a prior art CFA device, a model VXL-1169, to determine the voltage and current required for reliable turn-off control when operating at full duty and at rated rf output power. Similar measurements were then made on a VXL-1169 modified to include an auxiliary electrode as illustrated in FIGS. 2 and 2A above.

The unmodified CFA device required a peak control electrode voltage and current of 12 kV and 9.5 A for dependable turn-off control, whereas the device modified with the auxiliary electrode of this invention required only 7.5 kV and 5 A to operate dependably. Thus, the pulse energy requirements of the control electrode 17 were greatly relaxed. As noted above, similar advantages are expected from a variety of other auxiliary electrode embodiments in which the inverted magnetron arrangement traps electrons before the control electrode structure or away from the traveling wave space. Advantageously, the auxiliary electrode may be positioned around an edge of the cathode to create a diverting electron-trapping field. In yet other embodiments the control electrode may be provided with through-openings through which the electrons pass to the auxiliary electrode.

The invention being thus disclosed and representative embodiments thereof described, further variations and modifications will occur to those skilled in the art, and all such variations and modifications are considered to be within the spirit and scope of the invention set forth in the claims appended hereto and equivalents thereof.

What is claimed is:

1. A crossed-field device such as a crossed-field amplifier, said device including a peripheral cathode body portion having an emitter surface with a yield of electrons to enable sustained operation thereof and also having an anode portion spaced about said peripheral cathode portion such that an electric field is provided between said cathode portion and said anode portion in a gap along an interaction slow wave traveling region in which a magnetic crossed field cooperates to maintain emitted electrons on cycloidal pathways as the electrons travel between an inlet and an outlet of said crossed-field amplifier;

said inlet for providing a microwave frequency input signal for amplification by interaction with said electrons;

said outlet, for carrying an amplified microwave frequency signal from said device;

a control electrode positioned away from said slow-wave traveling region at a drift region, said control electrode being operable for interrupting sustained emission to shut down the device between working cycles; and an auxiliary electrode positioned internally of said peripheral cathode and positioned proximally of said control electrode for defining a secondary electron trap;

whereby biasing said auxiliary electrode reduces energy required on said control electrode.

2.The crossed-field device of claim 1, wherein the peripheral cathode body portion is comprised of a material having a secondary electron emission ratio greater than unity.

3. The crossed-field device of claim 2, wherein said peripheral cathode is defined by a cylinder, a major portion of the cathode extends about a perimeter of the cylinder between said inlet and said outlet to define an active amplification therebetween, and said control electrode extends along a minor portion of said perimeter between the outlet and the inlet to define a drift space therebetween, said control electrode being spaced across a gap from edges of said peripheral cathode.

4. The crossed-field device of claim 3, wherein said auxiliary electrode is positioned inside the perimeter of the cylinder to divert electrons traveling toward said control electrode into a gap, thereby reducing required operating energy of said control electrode.

5. The crossed-field device of claim 4, wherein said auxiliary electrode comprises an axially extending rod positioned in the gap.

6. The crossed-field device of claim 4, wherein said cathode is supported by a support structure, and said auxiliary electrode comprises a rod axially extending in a counter-bore of said support structure.

7. The crossed-field device of claim 1, wherein the device is a crossed-field amplifier.

8. The crossed-field device of claim 7, wherein said auxiliary electrode is configured for pulsed operation at anode potential.

9. The crossed-field device of claim 1, wherein the device is a magnetron.

10. The crossed-field device of claim 1, wherein said auxiliary electrode is configured for dc biasing.

11. The crossed-field device of claim 1, further comprising means for pulsing the control electrode toward anode potential during a turn-off phase, and wherein said auxiliary electrode is configured for pulsed or biased operation near anode potential.

12. The crossed-field device of claim 1, wherein the cathode comprises material having a cold secondary emission ratio greater than unity, and the auxiliary electrode comprises a metal having a heat and sputtering resistance at least as high as heat and sputtering resistance of material comprising said control electrode.

13. The crossed-field device of claim 1, having a cylindrical shape and having dimensions for receiving and amplifying a microwave rf signal.

14. The crossed-field device of claim 13, wherein said cathode and slow wave traveling region are configured for amplifying microwave power.

15. A crossed field amplifier tube having an anode and a cathode positioned along a slow wave path to amplify an rf input signal applied thereto when placed in a crossed magnetic field, a control electrode for quelling electrons to stop emission thereof when no input signal is present, and an auxiliary electrode located relative to the cathode to operate in an inverted magnetron configuration to capture secondary electrons from the slow wave path and permit operation of the control electrode at reduced potential.

16. A crossed-field amplifier, comprising a peripherally extending cathode having an electron emitter surface having a yield of secondary electrons to enable sustained operation thereof;

an anode spaced about and extending over a region across a gap from the cathode, said gap having an electric field therein;

said gap between said anode and said cathode defining an interaction region in which a magnetic crossed field cooperates to maintain emitted electrons on cycloidal pathways striking the cathode to sustain electron emission in the gap;

an rf inlet and an rf outlet for respectively providing rf energy to and receiving rf energy from said interaction region;

said inlet being positioned such that the rf energy initiates a traveling wave in said interaction region for amplification by interaction with said electrons so that said outlet receives an amplified rf output;

a control electrode positioned generally in a drift region away from said interaction region and being operable to interrupt sustained emission to thereby shut down the device between working cycles; and an auxiliary electrode positioned internally of said peripheral cathode and proximally of said control electrode to trap secondary electrons and reduce shutdown energy of said control electrode.

17. A crossed-field amplifier, comprising a peripherally extending cathode having an electron emitter surface having a yield of secondary electrons to enable sustained operation thereof;

an anode spaced about and extending over a region across a gap from the cathode, said gap having an electric field therein;

said gap between said anode and said cathode defining an interaction region in which a magnetic crossed field cooperates to return emitted electrons to the cathode to sustain electron emission in the gap;

an rf inlet and an rf outlet for respectively providing rf energy to and receiving rf energy from said interaction region;

said inlet being positioned such that the rf energy initiates a traveling wave in said interaction region for amplification by interaction with said electrons so that said outlet receives an amplified rf output;

a control electrode positioned generally in a drift region away from said interaction region and being operable to interrupt sustained electron emission and shut down the device between working cycles; and an auxiliary electrode positioned proximally of said control electrode and arranged in an inverted magnetron configuration with respect to said cathode for diverting secondary electrons when biased whereby said control electrode operates effectively with reduced power.

* * * * *